US009695789B2

(12) United States Patent
Tanada et al.

(10) Patent No.: US 9,695,789 B2
(45) Date of Patent: Jul. 4, 2017

(54) FUEL INJECTION VALVE

(71) Applicant: DENSO CORPORATION, Kariya, Aichi-pref. (JP)

(72) Inventors: Hiroki Tanada, Kariya (JP); Daiji Ueda, Kariya (JP); Motoya Kanbara, Nishio (JP)

(73) Assignee: DENSO CORPORATION, Kariya (JP)

( * ) Notice: Subject to any disclaimer, the term of this patent is extended or adjusted under 35 U.S.C. 154(b) by 101 days.

(21) Appl. No.: 14/953,658

(22) Filed: Nov. 30, 2015

(65) Prior Publication Data

US 2016/0258404 A1 Sep. 8, 2016

(30) Foreign Application Priority Data

Mar. 4, 2015 (JP) ..... 2015-42444

(51) Int. Cl.

| | |
|---|---|
| ***F02M 47/02*** | (2006.01) |
| ***F02M 61/04*** | (2006.01) |
| ***F02M 61/10*** | (2006.01) |
| ***F02M 63/00*** | (2006.01) |
| ***F02M 61/14*** | (2006.01) |

(52) U.S. Cl.

CPC ..... *F02M 61/045* (2013.01); *F02M 47/027* (2013.01); *F02M 61/10* (2013.01); *F02M 61/14* (2013.01); *F02M 63/0026* (2013.01); *F02M 63/0036* (2013.01); *F02M 2200/28* (2013.01)

(58) Field of Classification Search

CPC .. F02M 47/02; F02M 47/027; F02M 51/0603; F02M 61/045; F02M 61/10; F02M 61/14; F02M 63/0026; F02M 63/0036; F02M 2200/28

See application file for complete search history.

(56) References Cited

U.S. PATENT DOCUMENTS

| | | | | |
|---|---|---|---|---|
| 6,802,298 | B2 * | 10/2004 | Yoshimura | F02M 47/027 123/467 |
| 2006/0016906 | A1 | 1/2006 | Matsumoto | |
| 2006/0208106 | A1 * | 9/2006 | Boehland | F02M 45/086 239/533.2 |
| 2007/0170286 | A1 * | 7/2007 | Boecking | F02M 47/027 239/533.2 |
| 2009/0145404 | A1 * | 6/2009 | Heinz | F02M 47/027 123/456 |
| 2016/0115927 | A1 | 4/2016 | Tanada et al. | |

* cited by examiner

*Primary Examiner* — Darren W Gorman

(57) ABSTRACT

A valve cylinder partitions a first intermediate chamber from a second intermediate chamber. A first valve element in the first intermediate chamber includes a tubular high-pressure-side valve portion to control communication between a control chamber communication passage and the first intermediate chamber. A second valve element in the second intermediate chamber includes a low-pressure-side valve portion to control communication between an exhaust passage and the second intermediate chamber. A columnar rod portion located between the first valve element and the second valve element is slidably held at a cylinder hole of the valve cylinder. An internal passage communicates the control chamber communication passage with the second intermediate chamber. The high-pressure-side valve portion has an outer diameter greater than an outer diameter of the rod portion.

7 Claims, 3 Drawing Sheets

FUEL INJECTION VALVE

CROSS REFERENCE TO RELATED APPLICATION

This application is based on reference Japanese Patent Application No. 2015-042444 filed on Mar. 4, 2015, the disclosure of which is incorporated herein by reference.

TECHNICAL FIELD

The present disclosure relates to a fuel injection valve for injecting fuel into an internal combustion engine.

BACKGROUND

Patent Document 1 discloses one example of a fuel injection valve. In the fuel injection valve disclosed in Patent Document 1, fuel pressure in a control chamber acts to bias a nozzle needle in a closing direction. In this fuel injection valve, pressure in the control chamber is manipulated to control opening and closing operation of a nozzle needle.

More specifically, the fuel injection valve has a control chamber communication passage, which is communicated regularly with the control chamber. In this fuel injection valve, fuel in the control chamber is exhausted through the control chamber communication, passage and an exhaust passage into a low-pressure portion. In this way, fuel pressure in the control chamber is reduced thereby to move the nozzle needle in the opening direction. In addition, high-pressure fuel is supplied from a high-pressure passage through the control chamber communication passage into the control chamber. In this way, fuel pressure in the control chamber is increased thereby to move the nozzle needle in the closing direction.

This fuel injection valve includes a valve element accommodated in a valve chamber. The valve element controls communication between the control chamber communication passage and the exhaust passage and communication between the control chamber communication passage and the high-pressure passage. A valve element spring biases the valve element in a direction to block the control chamber communication passage from the exhaust passage. In addition, an actuator using a piezoelectric element actuates the valve element in a direction to block the control chamber communication passage from the high-pressure passage.

A closing speed of the needle may be desirably set high in order to retain an accuracy of an injection quantity. The closing speed of the needle may be set high by increasing a passage area of a throttle of the high-pressure passage.

It is noted that, the control chamber communication passage is blocked from the high-pressure passage in a needle closing state. In the needle closing state, the valve element is applied with a force caused by pressure of high-pressure fuel in a direction to communicate the control chamber communication passage with the high-pressure passage. Therefore, if the passage area of the throttle in the high-pressure passage is enlarged, an area, in which the valve element receives the pressure of high-pressure fuel, also increases in the state where the control chamber communication passage is blocked from the high-pressure passage. Consequently, the actuator is requested to produce a large actuating force to cause the valve element to retain the control chamber communication passage blocked from the high-pressure passage. That is, the actuator may be enlarged.

The fuel injection valve disclosed in Patent Document 1 utilizes, as an assist pressure, pressure in the valve chamber and the control chamber, when the valve element blocks the control chamber communication passage from the high-pressure passage, In this way, hydraulic pressure is applied onto the valve element in a direction to assist an actuating force of the actuator. Thus, the configuration of the fuel injection valve may reduce an actuating force required to the actuator.

(Patent Document 1)

Publication of unexamined Japanese patent application No. 2006-46323

It is noted that, in the fuel injection valve of Patent Document 1, hydraulic pressure acts as the assist pressure onto the valve element in the direction to assist the actuating force of the actuator when the control chamber communication passage is blocked from the high-pressure passage. To the contrary, high-pressure fuel also applies hydraulic pressure in a direction to oppose to the actuating force of the actuator.

It is further noted that, pressure of high-pressure fuel is higher than the assist pressure. Therefore, the hydraulic pressure in the direction to oppose to the actuating force of the actuator is greater than the hydraulic pressure in the direction to assist the actuating force of the actuator.

It may be assumable to increase a common rail pressure, which is pressure of high-pressure fuel, further than a pressure in the current status in order to, for example, improve a combustion state in an internal combustion engine. It may also be assumable to enlarge the passage area of the throttle in the high-pressure passage in order to increase a speed to close the needle. In those assumable cases, an actuating force required to an actuator may become greater than that of the current status. Consequently, an actuator may be inevitably enlarged.

SUMMARY

It is an object of the present disclosure to produce a fuel injection valve configured to reduce an actuating force required to an actuator.

According to an aspect, a fuel injection valve comprises a body having a nozzle hole to inject high-pressure fuel into a combustion chamber of an internal combustion engine. The fuel injection valve further comprises a nozzle needle movable back and forth in the body to open and close the nozzle hole. The fuel injection valve further comprises a control chamber configured to apply fuel pressure on the nozzle needle in a closing direction. The fuel injection valve further comprises a first intermediate chamber configured to be communicated with the control chamber through a control chamber communication passage, the first intermediate chamber configured to receive high-pressure fuel through a high-pressure passage. The fuel injection valve further comprises a second intermediate chamber communicated with a low-pressure portion through an exhaust passage. The fuel injection valve further comprises a valve cylinder partitioning the first intermediate chamber from the second intermediate chamber. The fuel injection valve further comprises a valve element configured to communicate the control chamber communication passage with the first intermediate chamber and to block the control chamber communication passage from the first intermediate chamber, the valve element configured to communicate the exhaust passage with the second intermediate chamber and to block the exhaust passage from the second intermediate chamber. The fuel injection valve further comprises a valve element spring configured to bias the valve element in a direction to communicate the control chamber communication passage with the first intermediate chamber and to block the exhaust passage from the second intermediate chamber. The fuel injection valve further comprises an actuator configured to actuate the valve element in a direction to block the control chamber communication passage from the first intermediate chamber and to communicate the exhaust passage with the second intermediate chamber. The valve element includes a first valve element located in the first intermediate chamber, the first valve element including a high-pressure-side valve portion in a tubular shape, the high-pressure-side valve portion configured to make contact with and to move away from a high-pressure seat surface, which is formed on the body, to block the control chamber communication passage from the first intermediate chamber and to communicate the control chamber communication passage with the first intermediate chamber. The valve element further includes a second valve element located in the second intermediate chamber, the second valve element including a low-pressure-side valve portion, the low-pressure-side valve portion configured to make contact with and to move away from a low-pressure seat surface, which is formed in the body, to block the exhaust passage from the second intermediate chamber and to communicate the exhaust passage with the second intermediate chamber. The valve element further includes a rod portion in a columnar shape, the rod portion located between the first valve element and the second valve element and slidably held at a cylinder hole, which is formed in the valve cylinder. The valve element further includes a valve element internal passage configured to communicate the control chamber communication passage with the second intermediate chamber. The high-pressure-side valve portion has an outer diameter, which is greater than an outer diameter of the rod portion.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, an embodiment of the present disclosure will be described.

A fuel injection valve of the present embodiment is configured to inject high-pressure fuel, which is supplied from a common rail (not shown), into a combustion chamber (not shown) of a compression ignition internal combustion engine.

Figure 1:
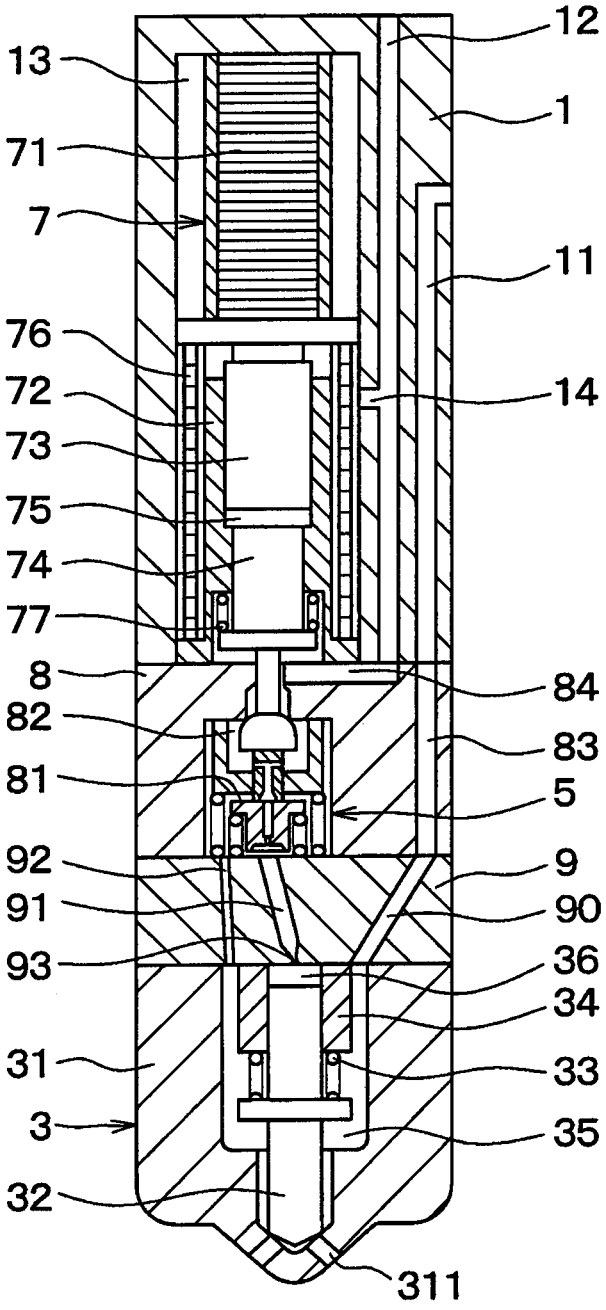
FIG. 1 is a sectional view showing a fuel injection valve in one operational state according to an embodiment of the present disclosure.
Figure 2:
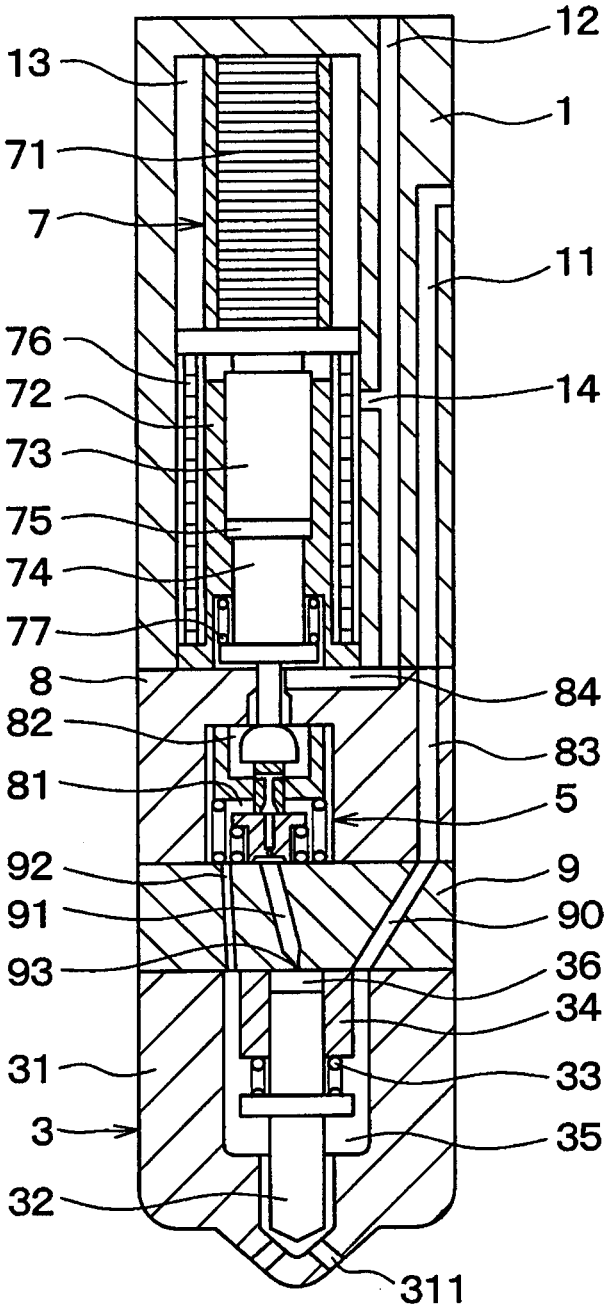
FIG. 2 is a sectional view showing the fuel injection valve in another operational state according to the embodiment.
Figure 3:
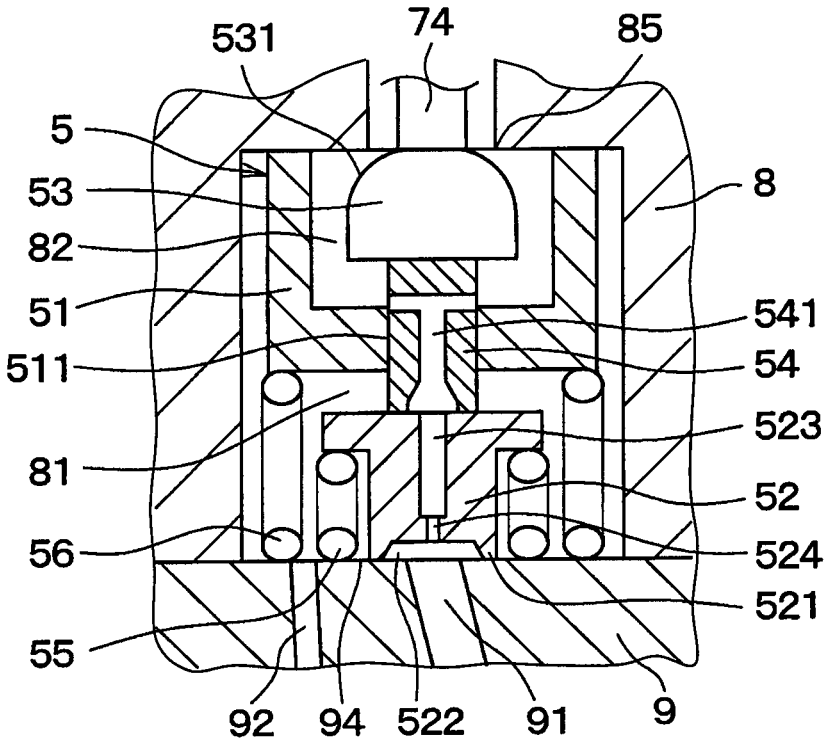
FIG. 3 is an enlarged sectional view showing a periphery of a control valve mechanism of FIG. 1.

As shown in FIGS. 1 to 3, the fuel injection valve includes, as main components, an injector body 1, a nozzle 3, a control valve mechanism 5, an actuator 7, a first intermediate body 8, a second intermediate body 9, and the like.

The injector body 1 is substantially in a bottomed tubular shape. The injector body 1 has a high-pressure fuel passage 11, a low-pressure fuel passage 12, and an accommodation chamber 13. The high-pressure fuel passage 11 conducts high-pressure fuel supplied from the common rail. The low-pressure fuel passage 12 is connected to a fuel tank (not shown) and is regularly at a low pressure. The accommodation chamber 13 accommodates the actuator 7. The accommodation chamber 13 is connected with the low-pressure fuel passage 12 through the low-pressure communication hole 14. The low-pressure fuel passage 12 is equivalent to a low-pressure portion of the present disclosure.

The first intermediate body 8 is located between the injector body 1 and the second intermediate body 9. The first intermediate body 8 accommodates the control valve mechanism 5. The first intermediate body 8 defines a first intermediate chamber 81, a second intermediate chamber 82, a high-pressure fuel passage 83, and an exhaust passage 84. The high-pressure fuel passage 83 communicates with the high-pressure fuel passage 11. The exhaust passage 84 is configured to communicate the second intermediate chamber 82 with the low-pressure fuel passage 12. The first intermediate chamber 81 and the second intermediate chamber 82 will be described later.

The nozzle 3 includes a nozzle body 31, a nozzle needle 32, a nozzle spring 33, and a nozzle cylinder 34. The nozzle body 31 is substantially in a bottomed tubular shape. The nozzle needle 32 is substantially in a column-shape and is slidably inserted in the nozzle body 31. The nozzle spring 33 biases the nozzle needle 32 in a closing direction. The injector body 1, the first intermediate body 8, the second intermediate body 9, and the nozzle body 31 may configure a body of the present disclosure.

The nozzle body 31 has a nozzle hole 311, which injects high-pressure fuel into the combustion chamber of the internal combustion engine. The nozzle needle 32 has a tip end (nozzle-hole-side end), which is lifted from and seated onto the nozzle body 31 thereby to open and close the nozzle hole 311.

The nozzle body 31 has an interior defining a fuel accumulator chamber 35, which is supplied with high-pressure fuel regularly from the common rail. High-pressure fuel flows from the common rail through the fuel accumulator chamber 35 into the nozzle hole 311.

The nozzle cylinder 34 is in a tubular shape. The nozzle cylinder 34 is biased from the nozzle spring 33 onto the second intermediate body 9. The nozzle needle 32 has a rear end (counter-nozzle-hole-side end), which is slidably inserted in the nozzle cylinder 34.

The nozzle cylinder 34 has an interior defining a control chamber 36, which is configured to switch its inner fuel pressure between a high pressure and a low pressure. The nozzle needle 32 is biased with pressure of fuel, which is in the control chamber 36, in the closing direction. The nozzle needle 32 is biased with pressure of fuel, which is in the fuel accumulator chamber 35, in the opening direction.

The second intermediate body 9 is located between the first intermediate body 8 and the nozzle body 31. The second intermediate body 9 defines a high-pressure fuel passage 90, a control chamber communication passage 91, and a high-pressure passage 92. The high-pressure fuel passage 90 communicates the high-pressure fuel passage 83 with the fuel accumulator chamber 35. The control chamber communication passage 91 is configured to communicate the first intermediate chamber 81 with the control chamber 36. The high-pressure passage 92 is configured to communicate the first intermediate chamber 81 with the fuel accumulator chamber 35. The control chamber communication passage 91 has an opening end on the side of the control chamber 36, and the opening end has an inflow throttle 93.

As shown in FIG. 3, the control valve mechanism 5 includes a valve cylinder 51, a first valve element 52, a second valve element 53, a rod portion 54, a valve element spring 55, and a cylinder holding spring 56.

The valve cylinder 51 is in a bottomed tubular shape and partitions the first intermediate chamber 81 from the second intermediate chamber 82. More specifically, the second intermediate chamber 82 is formed inside the valve cylinder 51. The second intermediate chamber 82 is defined by the valve cylinder 51 and the first intermediate body 8. The first intermediate chamber 81 is formed on the outside of the valve cylinder 51. The first intermediate chamber 81 is defined by the valve cylinder 51, the first intermediate body 8, and the second intermediate body 9.

The cylinder holding spring 56 is located between the valve cylinder 51 and the second intermediate body 9. The cylinder holding spring 56 and pressure of the high-pressure fuel in the first intermediate chamber 81 bias an opening-side end of the valve cylinder 51 onto the first intermediate body 8. The present configuration seals the first intermediate chamber 81 from the second intermediate chamber 82.

The valve cylinder 51 has a bottom portion having a center portion in the radial direction, and the center portion has a cylinder hole 511. The rod portion 54 is in a columnar shape and is slidably inserted in the cylinder hole 511.

The first valve element 52 is substantially in a columnar shape and is located in the first intermediate chamber 81. An outer circumferential periphery of an end of the first valve element 52 on the side of the second intermediate body 9 has a high-pressure-side valve portion 521. The high-pressure-side valve portion 521 is a tubular projection. An outer diameter of the high-pressure-side valve portion 521 is greater than an outer diameter of the rod portion 54. The high-pressure-side valve portion 521 of the first valve element 52 has an inner circumferential periphery defining a releasing portion 522. The releasing portion 522 is a space in a columnar shape.

The high-pressure-side valve portion 521 is lifted from and seated onto a high-pressure seat surface 94 of the second intermediate body 9 thereby to communicate the control chamber communication passage 91 with the first intermediate chamber 81 and to block the control chamber communication passage 91 from the first intermediate chamber 81. More specifically, in a state where the high-pressure-side valve portion 521 makes contact with the high-pressure seat surface 94, the control chamber communication passage 91 is blocked from the first intermediate chamber 81. In this state, the control chamber communication passage 91 communicates with the releasing portion 522, and the high-pressure passage 92 does not communicate with the releasing portion 522.

The first valve element 52 has an interior defining a first valve element internal passage 523. The first valve element internal passage 523 communicates the control chamber communication passage 91 with a rod internal passage 541 through the releasing portion 522. The rod internal passage 541 will be described later in detail. An opening end of the first valve element internal passage 523 on the side of the releasing portion 522 has an exhaust throttle 524. That is, the first valve element internal passage 523 has the exhaust throttle 524 on the side of the control chamber communication passage 91.

The second valve element 53 is substantially in a columnar shape and is located in the second intermediate chamber 82. An end of the second valve element 53 on the side of the injector body 1 has a low-pressure-side valve portion 531. The low-pressure-side valve portion 531 is in a tapered shape or in a hemispherical shape. The low-pressure-side valve portion 531 is lifted from and seated onto a low-pressure seat surface 85 of the first intermediate body 8 thereby to communicate the exhaust passage 84 with the second intermediate chamber 82 and to block the exhaust passage 84 from the second intermediate chamber 82.

The rod portion 54 has one end, which projects into the first intermediate chamber 81, and the other end, which projects into the second intermediate chamber 82. The rod portion 54 is located between the first valve element 52 and the second valve element 53. The rod portion 54, the first valve element 52, and the second valve element 53 are integrally movable.

The first valve element 52, the second valve element 53, and the rod portion 54 may form a valve element of the present disclosure. In the present embodiment, the valve element is divided into the first valve element 52, the second valve element 53, and the rod portion 54. It is noted that, the rod portion 54 may be integrally formed with the first valve element 52 and/or the second valve element 53.

The rod portion 54 has an interior defining the rod internal passage 541. The rod internal passage 541 is configured to communicate the second intermediate chamber 82 with the first valve element internal passage 523. In other words, the first valve element internal passage 523 and the rod internal passage 541 communicates the control chamber communication passage 91 with the second intermediate chamber 82. The first valve element internal passage 523 and the rod internal passage 541 may configure a valve element internal passage of the present disclosure.

The valve element spring 55 is interposed between the second intermediate body 9 and the first valve element 52. The valve element spring 55 biases the first valve element 52, the second valve element 53, and the rod portion 54 in a predetermined direction. Specifically, the valve element spring 55 biases the first valve element 52, the second valve element 53, and the rod portion 54 in a direction to communicate the control chamber communication passage 91 with the first intermediate chamber 81 and block the exhaust passage 84 from the second intermediate chamber 82.

The actuator 7 includes a piezo stack body 71 and a transmission unit. The piezo stack body 71 is formed by laminating a number of piezoelectric elements to be in a columnar shape. The piezo stack body 71 is charged with an electric charge and is caused to discharge an electric charge thereby to expand and to contract. The transmission unit transmits the expansion and the contraction of the piezo stack body 71 to the control valve mechanism 5.

The transmission unit has a configuration described as follows. A first piston 73 and a second piston 74 are slidably and liquid-tightly inserted in an actuator cylinder 72. The first piston 73 and the second piston 74 form a liquid chamber 75 therebetween. The liquid chamber 75 is charged with fuel.

The first piston 73 is biased with a first actuator spring 76 toward the piezo stack body 71. The piezo stack body 71 is configured to directly actuate the first piston 73. When the piezo stack body 71 expands, the first piston 73 is configured to increase pressure in the liquid chamber 75.

The second piston 74 is biased with a second actuator spring 77 toward the control valve mechanism 5. The second piston 74 is manipulated on application of pressure in the liquid chamber 75.

Specifically, when the piezo stack body 71 expands, the second piston 74 is manipulated on application of pressure of compressed fuel in the liquid chamber 75 thereby to actuate the first valve element 52, the second valve element 53, and the rod portion 54 toward the second intermediate body 9. In this way, the high-pressure-side valve portion 521 is caused to make contact with the high-pressure seat surface 94, thereby to block the control chamber communication passage 91 from the first intermediate chamber 81. In addition, the low-pressure-side valve portion 531 is lifted from the low-pressure seat surface 85 thereby to communicate the exhaust passage 84 with the second intermediate chamber 82.

To the contrary, when the piezo stack body 71 contracts, pressure of fuel in the liquid chamber 75 decreases. In this state, the second piston 74 is biased with the valve element spring 55 against resilience of the second actuator spring 77 toward the first piston 73.

Subsequently, an operation of the fuel injection valve will be described. First, in the state shown in FIG. 1, the fuel injection valve is in a needle closing state, and the nozzle hole 311 is closed. In this needle closing state, when the piezo stack body 71 is charged with an electric charge, the piezo stack body 71 expands to actuate the first piston 73. Thus, the first piston 73 is caused to increase pressure of fuel in the liquid chamber 75. Fuel in the liquid chamber 75 is compressed to apply pressure onto the second piston 74 thereby to manipulate the second piston 74 toward the first valve element 52 and second valve element 53.

Thus, as shown in FIGS. 2 and 3, the second piston 74 is caused to actuate the first valve element 52, the second valve element 53, and the rod portion 54 thereby to cause the high-pressure-side valve portion 521 to make contact with the high-pressure seat surface 94. Thus, the control chamber communication passage 91 is blocked from the first intermediate chamber 81, and the low-pressure-side valve portion 531 is lifted from the low-pressure seat surface 85. In this way, the exhaust passage 84 is communicated with the second intermediate chamber 82.

Therefore, fuel in the control chamber 36 flows through the control chamber communication passage 91, the releasing portion 522, the exhaust throttle 524, the first valve element internal passage 523, and the rod internal passage 541 and flows into the second intermediate chamber 82. The fuel further flows through the exhaust passage 84 and the low-pressure fuel passage 12 and flows into the fuel tank.

Consequently, pressure in the control chamber 36 decreases, and therefore, force, which biases the nozzle needle 32 in the closing direction, decreases. Thus, the nozzle needle 32 moves in the opening direction to be in a needle opening state. In this way, fuel is injected through the nozzle hole 311.

The outer diameter d1 of the high-pressure-side valve portion 521 is greater than the outer diameter d2 of the rod portion 54. When the high-pressure-side valve portion 521 makes contact with the high-pressure seat surface 94, the control chamber communication passage 91 is blocked from the first intermediate chamber 81. In this state, pressure P in the first intermediate chamber 81 causes a hydraulic pressure F applied to the first valve element 52 in a direction to assist an actuating force of the actuator 7. The hydraulic pressure F is as follows:

$$F \approx \pi/4 \times (((d1)^2 - (d2^2)) \times P)$$

To the contrary, when an electric charge of the piezo stack body 71 is discharged in the needle opening state shown in FIG. 2, the piezo stack body 71 contracts. In this way, the first actuator spring 76 acts to retract the first piston 73 toward the piezo stack body 71 thereby to reduce pressure in the liquid chamber 75. Thus, the valve element spring 55 acts to retract all the first valve element 52, the second valve element 53, the rod portion 54, and the second piston 74 toward the first piston 73.

In this way, the high-pressure-side valve portion 521 is caused to move away from the high-pressure seat surface 94, thereby to communicate the control chamber communication passage 91 with the first intermediate chamber 81. In addition, the low-pressure-side valve portion 531 is seated onto the low-pressure seat surface 85 thereby to block the exhaust passage 84 from the second intermediate chamber 82.

In this way, high-pressure fuel in the fuel accumulator chamber 35 flows through the high-pressure passage 92, the first intermediate chamber 81, the control chamber communication passage 91, and the inflow throttle 93 and flows into the control chamber 36.

Consequently, pressure in the control chamber 36 increases, and therefore, force, which biases the nozzle needle 32 in the closing direction, increases. Thus, the nozzle needle 32 moves in the closing direction to close the nozzle hole 311 to be in the needle closing state. In this way, fuel injection is completed.

According to the present embodiment, the outer diameter of the high-pressure-side valve portion 521 is greater than the outer diameter of the rod portion 54. Therefore, in the state where the control chamber communication passage 91 is blocked from the first intermediate chamber 81, hydraulic pressure acts on the first valve element 52 in the direction to assist actuating force of the actuator 7. Therefore, the present configuration enables to reduce an actuating force required to the actuator 7. Therefore, the present configuration enables to downsize the actuator 7. In addition, even in a case where common rail pressure is increased relative to a current status or even in a case where a passage area of the inflow throttle 93 is further enlarged, the present configuration enables to restrict enlargement of the actuator 7.

In addition, according to the present embodiment, the second valve element 53 and the rod portion 54 are divided from each other. Therefore, when the low-pressure-side valve portion 531 of the second valve element 53 is seated onto the low-pressure seat surface 85 of the first intermediate body 8, the low-pressure-side valve portion 531 and the low-pressure seat surface 85 automatically implements centering to adjust axes relative to each other. Therefore, the present configuration enables to produce a high sealing performance at a contact portion between the low-pressure-side valve portion 531 and the low-pressure seat surface 85.

In addition, the cylinder holding spring 56 and pressure of high-pressure fuel in the first intermediate chamber 81 bias the valve cylinder 51 onto the first intermediate body 8. Therefore, the valve cylinder 51 and the first intermediate body 8 enable to produce a high sealing performance at a contact portion therebetween.

A comparative example of a fuel injection valve according to Patent Document 2 has a control chamber accommodating a control plate and a plate spring. In the comparative example, the control plate has an exhaust throttle, and the plate spring biases the control plate toward a seat surface.

(Patent Document 2)

Japanese Patent Application No. 2014-219293

In the comparative example, when the fuel injection valve is rendered in a needle closing state, fuel in the control chamber is returned through the exhaust throttle into a fuel tank, similarly to the present embodiment. In the comparative example, when the fuel injection valve is rendered in a needle opening state to the contrary, high-pressure fuel flows into the control chamber without passing through the exhaust throttle, similarly to the present embodiment.

As described above, in the comparative example, both the control plate and the plate spring are located in the control chamber. Therefore, in the comparative example, the control chamber may need a large volume. Consequently, pulsation may occur in hydraulic pressure in the control chamber of the comparative example.

To the contrary, according to the present embodiment, the exhaust throttle 524 is located in the first valve element internal passage 523. In this way, the present configuration enables to reduce the volume of the control chamber 36. Therefore, the present configuration enables to reduce pulsation in hydraulic pressure in the control chamber 36 thereby to enhance a controllability of an injection quantity of the fuel injection valve.

Other Embodiment

In the above embodiment, the actuator 7 is configured with the piezo stack body 71 and the transmission unit. It is noted that, the actuator 7 may be configured to actuate the first valve element 52, the second valve element 53, and the rod portion 54 by utilizing an electromagnetic force.

In the above embodiment, the inflow throttle 93 is equipped in the control chamber communication passage 91. It is noted that, the inflow throttle 93 may be equipped in the high-pressure passage 92.

The present disclosure is not limited to the above embodiment and may be arbitrarily modified.

In the above embodiment, an element of the embodiment is not necessarily essential unless being specified essential or unless theoretically essential.

A numerical value of an element such as a quantity, a range, and/or the like exemplified in the above embodiment does not limit the present disclosure.

A feature of an element such as a shape, a relative relationship, and/or the like exemplified in the above embodiment does not limit the present disclosure.

The fuel injection valve according to the disclosure includes the body 1, 8, 9, 31, the nozzle needle 32, the control chamber 36, the first intermediate chamber 81, the second intermediate chamber 82, the valve cylinder 51, the valve element 52, 53, 54, the valve element spring 55, and the actuator 7. The body 1, 8, 9, 31 has the nozzle hole 311 for injecting high-pressure fuel into the combustion chamber of the internal combustion engine. The nozzle needle 32 is movable back and forth in the body to open and close the nozzle hole. The control chamber 36 applies fuel pressure to the nozzle needle in the closing direction. The first intermediate chamber 81 is communicated with the control chamber communication passage 91 through the control chamber. The first intermediate chamber 81 is supplied with high-pressure fuel through the high-pressure passage 92. The second intermediate chamber 82 is communicated with the low-pressure portion 12 through the exhaust passage 84. The valve cylinder 51 partitions the first intermediate chamber from the second intermediate chamber. The valve element 52, 53, 54 communicates the control chamber communication passage with the first intermediate chamber and blocks the control chamber communication passage from the first intermediate chamber. The valve element 52, 53, 54 communicates the exhaust passage with the second intermediate chamber and blocks the exhaust passage from the second intermediate chamber. The valve element spring 55 biases the valve element in the direction to communicate the control chamber communication passage with the first intermediate chamber and to block the exhaust passage from the second intermediate chamber. The actuator 7 actuates the valve element in the direction to block the control chamber communication passage from the first intermediate chamber and to communicate the exhaust passage with the second intermediate chamber. The valve includes the first valve element 52, the second valve element 53, and the rod portion 54. The first valve element 52 is located in the first intermediate chamber. The first valve element 52 includes the high-pressure-side valve portion 521, which is in the tubular shape. The high-pressure-side valve portion 521 makes contact with the high-pressure seat surface 94, which is formed in the body, to block the control chamber communication passage from the first intermediate chamber. The high-pressure-side valve portion 521 moves away from the high-pressure seat surface 94 to communicate the control chamber communication passage with the first intermediate chamber. The second valve element 53 is located in the second intermediate chamber. The second valve element 53 includes the low-pressure-side valve portion 531. The low-pressure-side valve portion 531 makes contact with the low-pressure seat surface 85, which is formed in the body, to block the exhaust passage from the second intermediate chamber. The low-pressure-side valve portion 531 moves away from the low-pressure seat surface 85 to communicate the exhaust passage with the second intermediate chamber. The rod portion 54 is in a columnar shape. The rod portion 54 is located between the first valve element and the second valve element. The rod portion 54 is slidably held at the cylinder hole 511, which is formed in the valve cylinder. The valve element internal passage communicates the control chamber communication passage with the second intermediate chamber 523, 541. The outer diameter of the high-pressure-side valve portion is greater than the outer diameter of the rod portion.

According to the present configuration, the outer diameter of the high-pressure-side valve portion is greater than the outer diameter of the rod portion. Therefore, in the state where the first valve element blocks the control chamber communication passage from the first intermediate chamber, high-pressure fuel in the first intermediate chamber applies hydraulic pressure on the first valve element in the direction to assist the actuating force of the actuator. Therefore, the present configuration enables to reduce the actuating force required to the actuator. Thus, the present configuration enables to downsize the actuator.

In addition, the present configuration enables to avoid enlargement of the actuator even in a case where the common rail pressure is increased relative to a common rail pressure in the current status or even in a case where the passage area of the throttle in the high-pressure passage is further enlarged.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injection valve comprising:

a body having a nozzle hole to inject high-pressure fuel into a combustion chamber of an internal combustion engine;

a nozzle needle movable back and forth in the body to open and close the nozzle hole;

a control chamber configured to apply fuel pressure on the nozzle needle in a closing direction;

a first intermediate chamber configured to be communicated with the control chamber through a control chamber communication passage, the first intermediate chamber configured to receive high-pressure fuel through a high-pressure passage;

a second intermediate chamber communicated with a low-pressure portion through an exhaust passage;

a valve cylinder partitioning the first intermediate chamber from the second intermediate chamber;

a valve element configured to communicate the control chamber communication passage with the first intermediate chamber and to block the control chamber communication passage from the first intermediate chamber, the valve element configured to communicate the exhaust passage with the second intermediate chamber and to block the exhaust passage from the second intermediate chamber;

a valve element spring configured to bias the valve element in a direction to communicate the control chamber communication passage with the first intermediate chamber and to block the exhaust passage from the second intermediate chamber; and an actuator configured to actuate the valve element in a direction to block the control chamber communication passage from the first intermediate chamber and to communicate the exhaust passage with the second intermediate chamber, wherein the valve element includes:

a first valve element located in the first intermediate chamber, the first valve element including a high-pressure-side valve portion in a tubular shape, the high-pressure-side valve portion configured to make contact with and to move away from a high-pressure seat surface, which is formed on the body, to block the control chamber communication passage from the first intermediate chamber and to communicate the control chamber communication passage with the first intermediate chamber;

a second valve element located in the second intermediate chamber, the second valve element including a low-pressure-side valve portion, the low-pressure-side valve portion configured to make contact with and to move away from a low-pressure seat surface, which is formed in the body, to block the exhaust passage from the second intermediate chamber and to communicate the exhaust passage with the second intermediate chamber;

a rod portion in a columnar shape, the rod portion located between the first valve element and the second valve element and slidably held at a cylinder hole, which is formed in the valve cylinder; and a valve element internal passage configured to communicate the control chamber communication passage with the second intermediate chamber, wherein the high-pressure-side valve portion has an outer diameter, which is greater than an outer diameter of the rod portion.

2. The fuel injection valve according to claim 1, wherein the valve element has a throttle in the valve element internal passage.

3. The fuel injection valve according to claim 2, wherein the throttle is located at an end of the valve element internal passage on a side of the control chamber communication passage.

4. The fuel injection valve according to claim 1, wherein the valve element is separated into the first valve element, the second valve element, and the rod portion.

5. The fuel injection valve according to claim 1, wherein the rod portion is integrally formed with one of the first valve element and the second valve element.

6. The fuel injection valve according to claim 1, wherein the first intermediate chamber and the second intermediate chamber are defined by the body and the valve cylinder, and the valve cylinder is biased from a cylinder spring toward the body and is configured to seal between the first intermediate chamber and the second intermediate chamber.

7. The fuel injection valve according to claim 1, wherein the first intermediate chamber and the second intermediate chamber are defined by the body and the valve cylinder, and the valve cylinder is biased from high-pressure fuel, which is in the first intermediate chamber, toward the body and configured to seal between the first intermediate chamber and the second intermediate chamber.

* * * * *